US007083458B1

(12) United States Patent
Chang

(10) Patent No.: US 7,083,458 B1
(45) Date of Patent: Aug. 1, 2006

(54) STRUCTURE OF A SOCKET

(76) Inventor: Chi-Tsai Chang, P.O. Box 82-144, Taipei (TW)

( * ) Notice: Subject to any disclaimer, the term of this patent is extended or adjusted under 35 U.S.C. 154(b) by 0 days.

(21) Appl. No.: 10/309,104

(22) Filed: Dec. 4, 2002

(51) Int. Cl.
*H01R 4/50* (2006.01)

(52) U.S. Cl. ..... 439/346; 439/263
(58) Field of Classification Search ..... 439/346, 439/304, 263, 102
See application file for complete search history.

(56) References Cited

U.S. PATENT DOCUMENTS 5,791,931 A * 8/1998 Burkhart, Sr. ..... 439/346
6,193,539 B1 * 2/2001 Chang ..... 439/346
6,428,333 B1 * 8/2002 Rust ..... 439/140

* cited by examiner

*Primary Examiner*—Tho D. Ta
*Assistant Examiner*—James R. Harvey
(74) *Attorney, Agent, or Firm*—Leong C. Lei

(57) ABSTRACT

A structure of a socket includes a socket body, a pressing device, a positioning member, an oscillating member, a covering plate and an actuating member, wherein the fixing member at least a slot in which is fitted the pressing device, the pressing device including an upper member, a lower and a spring mounted between the upper and lower members, the positioning member is mounted in a mouth of the slot, a top of the positioning member has a through hole, a lower end of the positioning member is provided with a pin, the pin of the positioning member is inserted into a hole of the oscillating member which is made of metal, the positioning member has a shoulder which extends out of the fixing frame, the fixing frame is provided with at least a tubular member, the actuating member is provided with a downwardly extending pin and a downwardly extending plate formed with an inclined edge, the actuating member is fitted on the covering plate, the actuating member has a top end protruded above the covering plate, the covering plate being formed at a bottom with grooves for engaging three conducting members made of copper.

1 Claim, 3 Drawing Sheets

STRUCTURE OF A SOCKET

CROSS-REFERENCE

This application is related to U.S. Pat. No. 6,193,539, owned by the same applicant.

BACKGROUND OF THE INVENTION (a) Field of the invention

The present invention relates to an improved structure of a socket and in particular to a socket which allows the prongs of a plug to trigger the pressing device of the socket to press downward and in turn to fasten or secure the prongs of the plug such that the prongs will not be dislocated from the socket.

b) Description of the prior art

The purpose of a connection between a socket and a plug is to provide an extension of current supply from a source.

In the currently available sockets, the stability of these sockets depends on the clipping force of the conductive elements within the socket. As such, when the sockets have been used for a long time or the size of the prongs of a socket is not accurate with respect to the insertion holes of the socket, the retention or the clipping force of the conductive elements becomes weak or loose. In such case, when the socket or the plug of an electrical appliance is accidentally touched, the plug may dislocate or fall off from the socket and thus, an interruption of current supply is occurred. To solve this problem, most of the people may widen or narrow the distance in between the two prongs of the plug so as to fix the prongs to the socket. By the adjust t of the distance of the prongs to be inserted into the socket, the clipping of the prongs maybe improved. However, in actual practice, such adjustment does not improved the stability or the mounting capability of the socket. This is because the prongs are normally rigidly fixed to the plug structure and are not flexible. The prongs are not easily extended and if they are extended with great force, the rigidly fixed ends of the prongs within the plug may be damaged. This way of adjusting the clipping ability of the plug to fit the socket is not feasible. Another way to solve this problem is to change the insertion holes of a socket But, in actual practice, this method is not possible as the clipping force of a socket is greatly depending on the elasticity of the conductive elements of the socket With regard to the sent supply to computers, where the cent supply cannot be interrupted, unexpected current interruption often causes a great loss to the users.

Therefore, it is an object of the present invention to design a socket with improved structure, which provides sewed retention of the prongs of a plug at the socket.

SUMMARY OF THE INVENTION

The present invention relates to an improved structure of a socket which ensures a secured retention of a plug connected to the socket. The socket comprises an oscillating member being pivotally mounted at the lower end of a positioning member.

The object of the present invention is therefore to provide an improved retention structure of a socket capable of firmly secure the prongs of a plug when the prongs are inserted into the socket It is another object of the present invention to provide an improved retention structure of a socket which substantially eliminates or reduces disadvantages and problems associates with related prior art-sockets.

Additional objects and advantages of the invention will be set forth in the description which follows. The object and advantages of the invention may be realized and obtained in the appended claims.

The foregoing object and summary provide only a brief introduction to the present inventor. To fully appreciate these and other objects of the present invention as well as the invention itself all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary Odin of the invention. Various changes to the described embodiments may be made in the function and arrangement of the elements described without departing from the scope of the invention as set forth in the appended claims.

Figure 1:
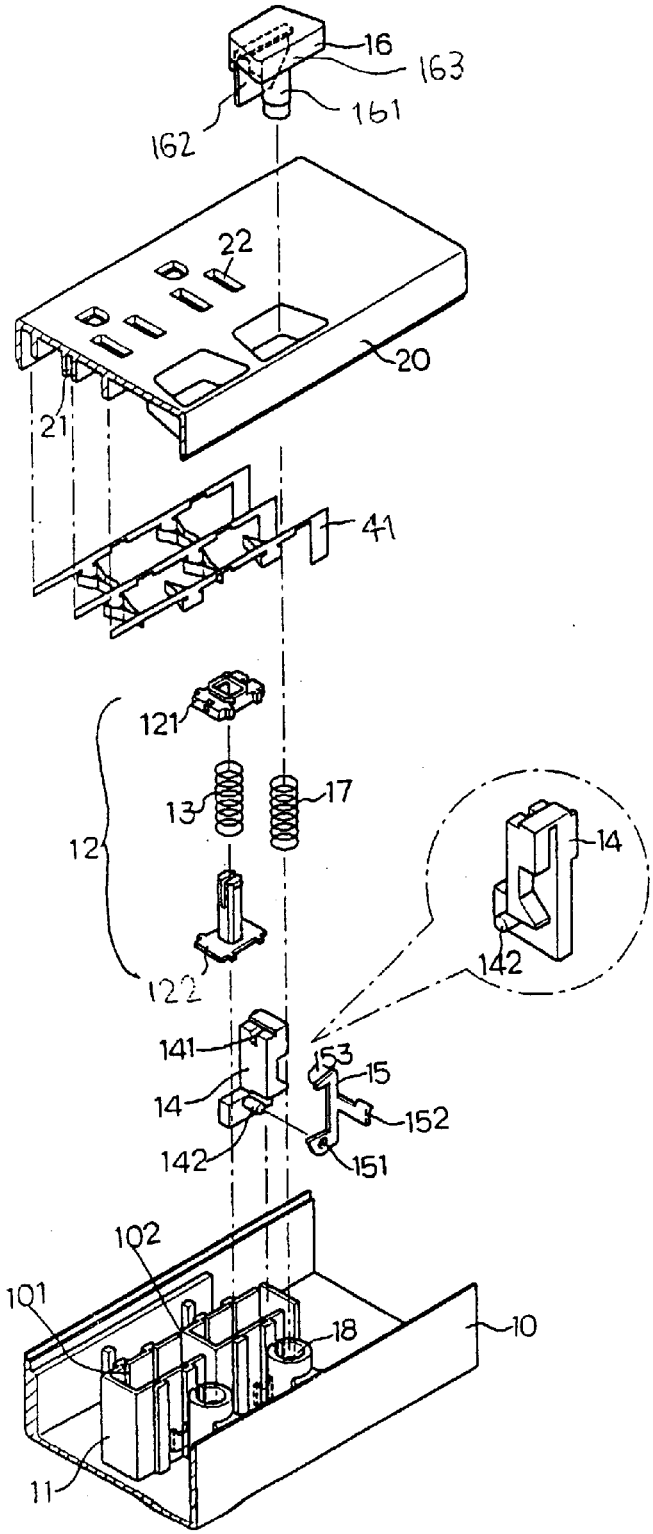
FIG. 1 is a perspective exploded view of a socket in accordance with the present invention.

With reference to the drawings and in particular to FIG. 1 thereof the socket according to the present invention compresses a U-shaped body portion 10, a pressing device 12, a positioning member 14, an oscillating member 15, a covering plate 20, and an actuating member 16. On the U-shaped body portion 10 is mounted a fixing frame 11. The fixing flame 11 has the same height as the U-shaped body portion 10. The fixing fame 11 is an elongated member formed with two slots 101 in each of which is fitted the pressing device 12. The pressing device 12 includes an upper member 121, a spring 13 and a lower member 122. The positioning member 14 is mounted in the mouth 102 of the slot 101. The top of the positioning member 14 has a through hole 141, and the lower end of the positioning member 14 is provided with a pin 142. The pin 142 of the positioning member 14 is inserted into a hole 151 of the oscillating member 15 which is made of metal, so that the oscillating member 15 can be rotated about the pin 142. The positioning member 14 has a shoulder 152 which extends out of the fixing frame 11. The fixing flame 11 is provided with two tubular members 18. The actuating member 16 is provided with a downwardly extending pin 161 and a downwardly extending plate 162 formed with an inclined edge 163. The actuating member 16 is fitted on the covering plate 20, so that the downwardly extending pin 161 goes tough a spring 17 into the tubular member 18. The upper surface of the actuating member 16 is even with or slightly higher than the top of the covering plate 20. The covering plate 20 is formed at the bottom with grooves 21 for engaging three conducting members 41 made of copper, so that when a plug 30 is inserted into insertion holes 22 of the covering plate 20, the prongs 31 of the plug 30 will be in contact with the conducting members 41. The conducting members 41 are connected with a power source (not shown).

Figure 2:
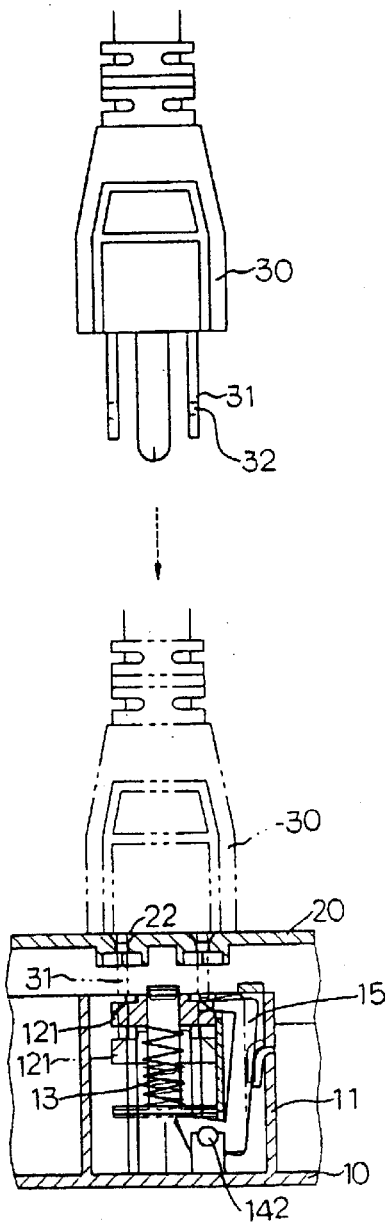
FIG. 2 illustrates a plug which is being inserted into the socket in accordance with the present invention.
Figure 4:
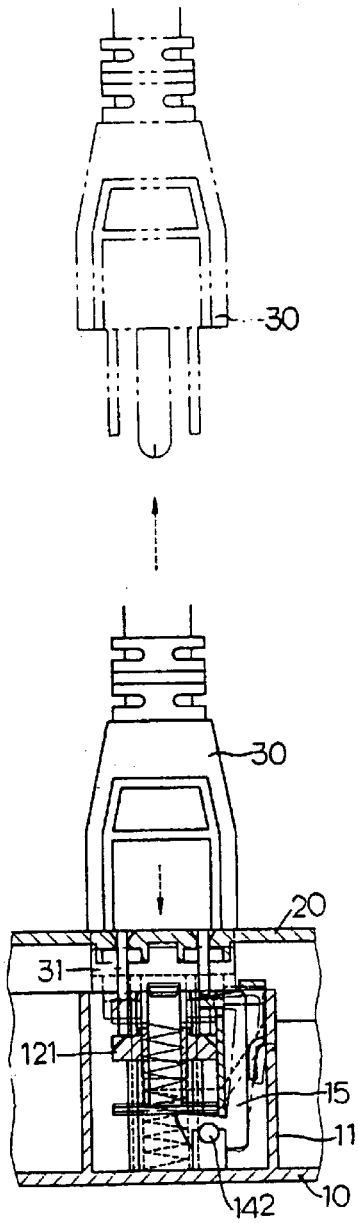
FIG. 4 illustrates the connection between the plug and the socket in accordance with the present invention.
Figure 3:
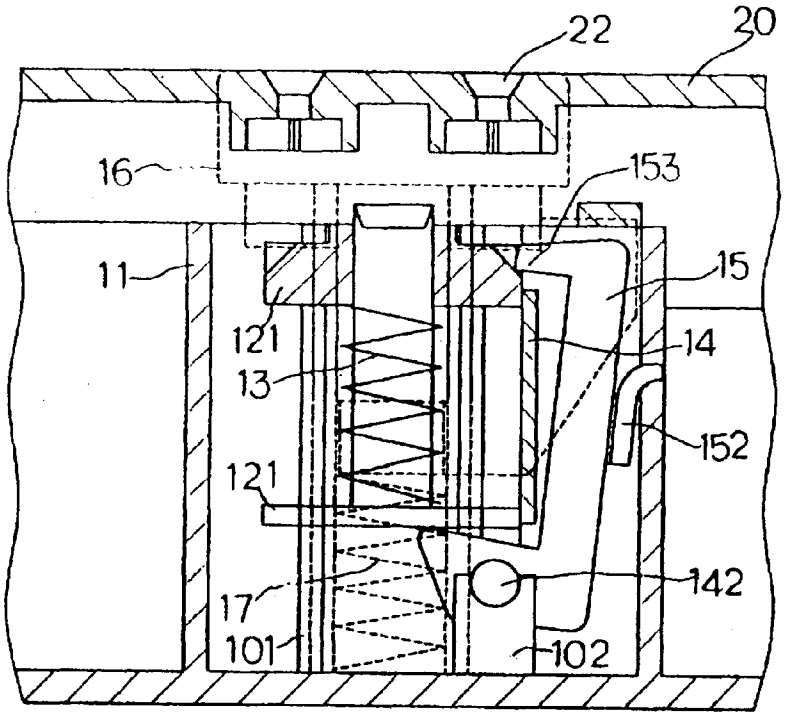
FIG. 3 is a sectional view of the present invention.

As shown in FIGS. 2,3 and 4, when the prongs 31 of the plug 30 are inserted into the socket via the confiding insertion holes 22 provided on the covering plate 20 of the socket, the upper plate 121 will be depressed by the prongs 31 thereby pushing the lower plate 122 to force the lower end of the oscillating member 15 to a horizontal flat position. Due to the depression of the oscillating member 15 at the lower end, the top section of the oscillating member 15 moves forward to the prongs 31 and the protrusions 151 a the top end of the oscillating member 15 also move forward and are inserted into the holes 32 provided at the end of the prongs 31 and a secured retention of the prongs 31 is obtained. Thus, the secured prongs 31 will not be dislocated from the socket.

When desired to disconnect the plug 30 from the socket, the top end of the actuating member 16 (the actuating member 16 has a top end slightly protruded above the covering plate 20) is depressed thereby forcing the inclined edge 163 of the depending plate 162 of the actuating member 16 to urge the shoulder 152 to move outwardly and therefore disengaging the protrusions 153 from the holes 32 of the prongs 31. Accordingly, the prongs 30 can be easily disconnected from the socket. At this moment, the upper plate 12 will restore to its position and the oscillating member will also restore to its original position before the insertion of the plug.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a socket comprising a socket body, a pressing device, a positioning member, an oscillating member, a covering plate and an actuating member, wherein a fixing frame having at least slot in which is fitted said pressing device, said pressing device including an upper member, a lower member and a spring mounted between said upper and lower members, said positioning member is mounted in a mouth of said slot, a top of said positioning member has a through hole, a lower end of said positioning member is provided with a pin, said pin of said positioning member is inserted into a hole of said oscillating member which is made of metal, so that said oscillating member is rotatable about said pin, said positioning member has a shoulder which extends out of said fixing frame, said fixing frame is provided with at least a tubular member, said actuating member is provided with a downwardly extending pin and a downwardly extending plate formed with an inclined edge, said actuating member is fitted on said covering plate so that said downwardly extending pin goes through a spring into said tubular member, said actuating member has a top end protruded above said covering plate, said covering plate being formed at a bottom with grooves for engaging three conducting members made of copper such that when a plug is inserted into insertion holes of said covering plate, prongs of said plug will be in contact with said conducting members, and said upper plate will be depressed by said prongs thereby pushing said lower plate to force a lower end of said oscillating member to a horizontal flat position and moving a top section of said oscillating member forward to said prongs and therefore causing protrusions at a top end of the oscillating member to move forward and inert into holes provided at an end of said prongs.

* * * * *